US005945962A

United States Patent [19]

Harrington et al.

[11] Patent Number: 5,945,962

[45] **Date of Patent: *Aug. 31, 1999**

[54] BROAD BAND SHAPED ELEMENT DIPOLE ANTENNA

[75] Inventors: Timothy E. Harrington, Austin, Tex.; James S. McLean, Madison, Wis.; Zhong Chen; F. Gary Rodriguez, both of Austin, Tex.

[73] Assignee: EMC Test Systems, L.P., Austin, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/699,469

[22] Filed: Aug. 19, 1996

[51] Int. Cl.[6] ..... H01Q 11/10

[52] U.S. Cl. ..... 343/792.5; 343/803; 343/807; 343/808

[58] Field of Search ..... 343/795, 807, 343/808, 803, 792.5, 804

[56] References Cited

U.S. PATENT DOCUMENTS

| | | | |
|---|---|---|---|
| 2,175,253 | 10/1939 | Carter | 343/795 |
| 2,175,254 | 10/1939 | Carter | 343/807 |
| 3,543,277 | 11/1970 | Pullara | 343/792.5 |
| 3,573,839 | 4/1971 | Parker, Jr. | 343/792.5 |
| 3,875,572 | 4/1975 | Kay | 343/803 |
| 4,593,289 | 6/1986 | Newcomb | 343/795 |
| 4,754,287 | 6/1988 | Shelton et al. | 343/792.5 |
| 5,057,850 | 10/1991 | Kuo | 343/792.5 |
| 5,289,198 | 2/1994 | Altshuler | 343/729 |
| 5,293,176 | 3/1994 | Elliot | 343/807 |
| 5,367,312 | 11/1994 | Masters | 343/807 |
| 5,418,544 | 5/1995 | Elliot | 343/807 |

OTHER PUBLICATIONS

Balanis, Constantine A., *Antenna Theory Analysis and Design,* Chapter 8 "Broadband Dipoles and Matching Techniques," New York: John Wiley & Sons, Inc., 1982, pp. 340–347.

*Primary Examiner*—Michael C. Wimer
*Attorney, Agent, or Firm*—Akin, Gump, Strauss, Hauer & Feld, L.L.P.

[57] ABSTRACT

A broad band electrically small antenna comprising opposed wire triangular outline shaped elements connected to a source or receiver at their respective apexes and a second set of wire triangular outline shaped elements connected to the base members of the first set of triangular shaped or "bowtie" elements and extending generally parallel thereto and spaced from the first set. The antenna exhibits a low antenna factor and voltage standing wave ratio at relatively low frequencies in the range of 20 to 200 megahertz, for example. The folded triangular shaped element antenna is connected to a log periodic dipole antenna array to provide broad band reception and transmission characteristics. A second single plane or folded triangular element or bowtie antenna may be mounted on and electrically connected to the array to improve the operating range of the antenna.

15 Claims, 8 Drawing Sheets

BROAD BAND SHAPED ELEMENT DIPOLE ANTENNA

FIELD OF THE INVENTION

The present invention pertains to a broad band shaped element dipole antenna, particularly an apex fed, opposed, folded triangular element or "bowtie" antenna and a log periodic and folded shaped element antenna array useful in electromagnetic emissions and immunity measurements.

BACKGROUND

Antennas used in analyzing electromagnetic radiation emissions and immunity of various devices should have relatively broad band or so-called frequency independent operating capability. Moreover, it is desirable to minimize the physical size of such an antenna for portability as well as cost considerations. For a considerable portion of the frequency band used in the above-mentioned electromagnetic compatibility testing, as well as in some communication applications, a half wave length dipole antenna is physically too large for many operating environments. In this regard, physical size restraints often require the use of so-called electrically small antennas or antennas that resonate at a resonance frequency corresponding to about 0.1 wave length of the emitted or received signal. Impedance matching or providing some form of radiating element shaping or loading, or both, can produce a dipole type antenna that will resonate at a frequency lower than that determined by its dimensions relative to the half wave length resonance frequency of conventional dipole antennas.

A popular form of shaped element dipole antenna is the so-called opposed triangular outline wire or "bowtie" antenna. The triangular outline wire antenna is an approximation to the infinite planar sheet triangular element antenna, which is substantially frequency independent. A conventional planar triangular outline wire bowtie antenna resonates at a frequency where its length is about 0.32 wavelength of the emitted or sensed radiation. However, in the above-referenced electromagnetic compatibility testing application, as well as in certain communications applications, it has been considered desirable to decrease the resonance frequency further so that the antenna may be operated to emit or sense radiation at low antenna loss factors and greater signal resolution and strength in lower frequency ranges. In particular, it has been considered desirable in the application of electromagnetic compatibility test antennas to provide suitable antenna operation at radiation frequencies below 200 megahertz and particularly down to frequencies as low as 20 megahertz. It is to these ends that the present invention has been developed with a view to providing a shaped element dipole antenna with a lower resonance frequency and, in combination with other antenna arrays, such as log periodic dipole antenna arrays, for use at signal frequencies below the resonance frequency. In such circumstances, any improvement in antenna gain is welcome.

SUMMARY OF THE INVENTION

The present invention provides an improved shaped element dipole antenna. The present invention also provides an improved shaped element dipole antenna and log periodic dipole antenna configured in an antenna array. The improved antenna and antenna array of the present invention is particularly adapted for measuring electromagnetic emissions and immunity of certain devices and sources, also known as electromagnetic compatibility (EMC) testing. Such antennae are also useful in certain communications applications.

In accordance with one aspect of the present invention, a shaped element dipole antenna is provided wherein opposed triangular shaped wire elements are connected to a signal source or receiver wherein the signal source or receiver is connected to the apex of the triangular elements and the elements are physically and electrically connected to a second set of triangular shaped wire elements spaced a predetermined distance from the first set of elements. The configuration may be considered a folded triangular element dipole antenna and has a significantly lower resonance frequency than a so-called single wire dipole antenna of the same physical length. Accordingly, the improved shaped element dipole antenna may be used in applications wherein antenna losses are minimized at lower frequencies than is possible with a folded wire dipole antenna of the same physical size.

The above described triangular shaped element antenna, with a suitable balun transformer can be operated alone as an electric field transmitting or receiving antenna and is an improvement over the well known, so-called biconical antenna used in electromagnetic emissions and immunity testing.

Moreover, it has been discovered that the improved folded triangular shaped element dipole antenna, in combination with a log periodic dipole array, provides an antenna adapted for improved antenna performance over a considerably wider frequency range. Still further, the combination of the folded triangular element antenna and log periodic dipole array can provide improved performance with a single triangular element dipole antenna or so-called triangular outline wire bowtie type antenna disposed in the array. This arrangement provides a lower antenna factor and voltage standing wave ratio (VSWR) in an operating signal frequency range between the optimum frequency ranges of the log periodic dipole array and the folded triangular element dipole antenna. A second folded bowtie antenna may be used in place of the single triangular element dipole antenna. The folded triangular element dipole antenna and the single opposed triangular element antenna may have additional radial struts between the strut elements defining the triangular outline to more closely approximate a planar sheet triangular antenna. The struts as well as the apices of the second set of triangular elements may be provided with lumped impedances to influence the resonance frequency.

Those skilled in the art will further appreciate the above-mentioned features and advantages of the invention together with other important aspects thereof upon reading the detailed description which follows in conjunction with the drawing.

DESCRIPTION OF THE PREFERRED EMBODIMENTS

Figure 1:
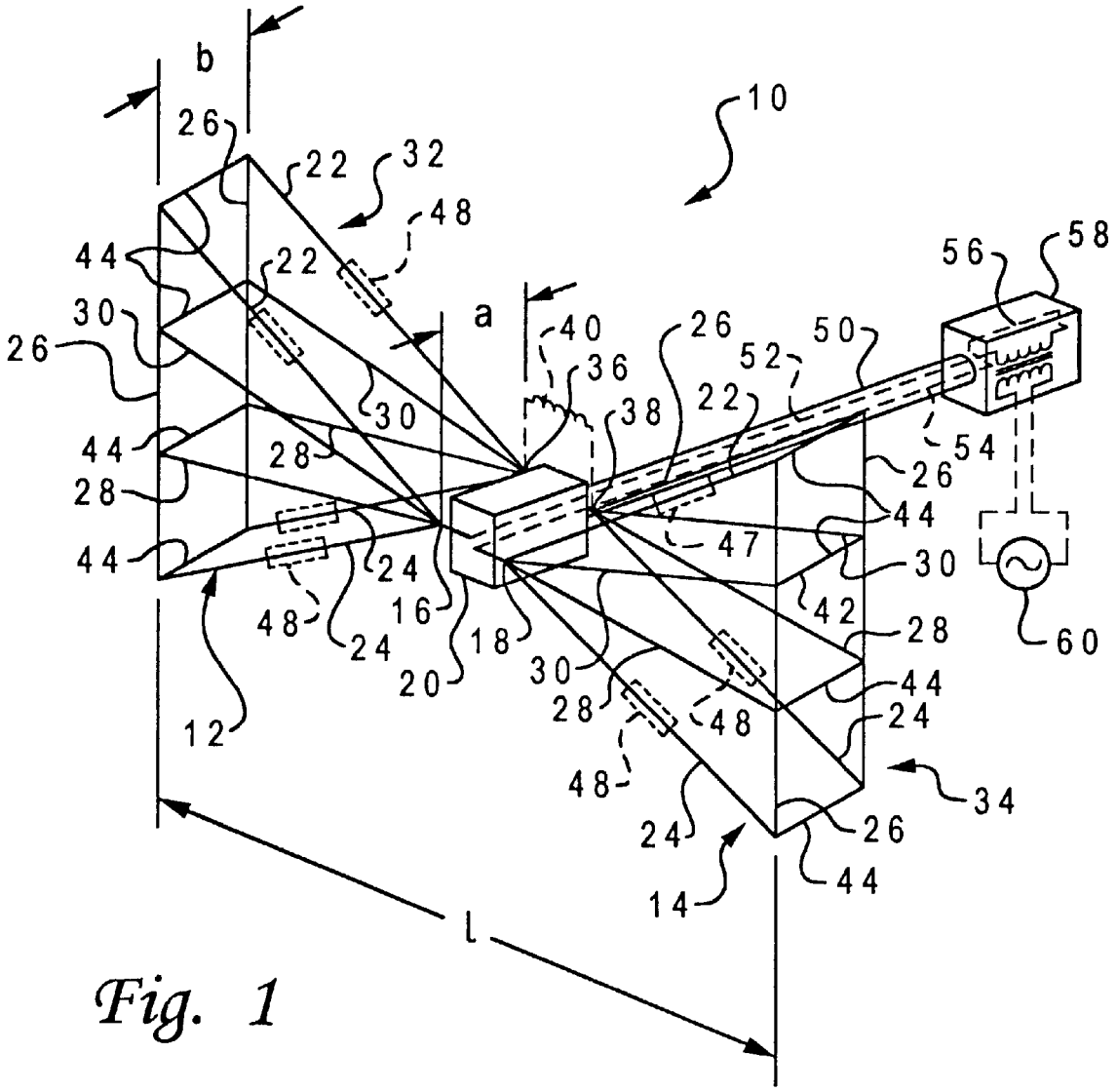
FIG. 1 is a perspective view, in somewhat schematic form, of a folded shaped element dipole antenna of the present invention.

In the description which follows, like elements are marked throughout the specification and drawing with the same reference numerals, respectively. The drawing figures are not necessarily to scale and certain elements are shown in somewhat generalized or schematic form in the interest of clarity and conciseness.

Referring to FIG. 1, there is illustrated a shaped element dipole antenna in accordance with the invention and generally designated by the numeral 10. The antenna 10 is characterized by a first pair of opposed triangular shaped elements 12 and 14 having respective apexes 16 and 18 suitably supported on a support member 20. The triangular antenna element 12 has opposed, diverging, wire or metal tube outer strut members 22 and 24 interconnected by a triangular base member 26 and also connected to each other at the apex 16. Intermediate spaced apart diverging strut members 28 and 30 also interconnect apex 16 with base member 26. Triangular element 14 is also provided with opposed diverging strut members 22 and 24 extending from apex 18 to a base member 26. Intermediate wire or tube struts 28 and 30 also extend from apex 18 to wire or tube base member 26.

Antenna 10 is also provided with a second set of opposed triangular elements 32 and 34 which also extend from apexes 36 and 38 suitably supported on the support 20 and either electrically isolated from each other or interconnected by a suitable conductive element 40, as indicated. Triangular elements 32 and 34 are also made up of outer diverging strut members 22 and 24 extending from the apexes 36 and 38 and connected to base members 26. Still further, antenna elements 32 and 34 also include diverging intermediate struts 28 and 30. Antenna elements 12 and 32 are interconnected at their respective bases 26 by transverse strut members 44 spaced apart as shown and interconnecting the respective bases 26 at the junctures of the bases with the diverging struts 22, 24, 28 and 30. In like manner, antenna elements 14 and 34 are interconnected at their respective bases 26 by spaced apart transverse strut members 44 also interconnecting the bases at the junctures of the bases with diverging struts 24, 26, 28 and 30. At least the struts 22 and 24 of the respective triangular elements 12, 14, 32 and 34 may also, if desired, be provided with suitable lumped impedances 48, representative ones of which are shown in FIG. 1, for modifying the resonance frequency of the antenna 10.

As also shown in FIG. 1, the support 20 may be connected to a further support member 50 comprising a boom or mast through which suitable conductors 52 and 54 are trained and are connected to the antenna apexes 16 and 18, respectively. Conductors 52 and 54 are also connected to a suitable balun transformer 56 disposed in a suitable enclosure 58. Conductors 52 and 54 are also in communication with a suitable signal source 60, the reciprocal of which may be a suitable receiver.

Figure 2:
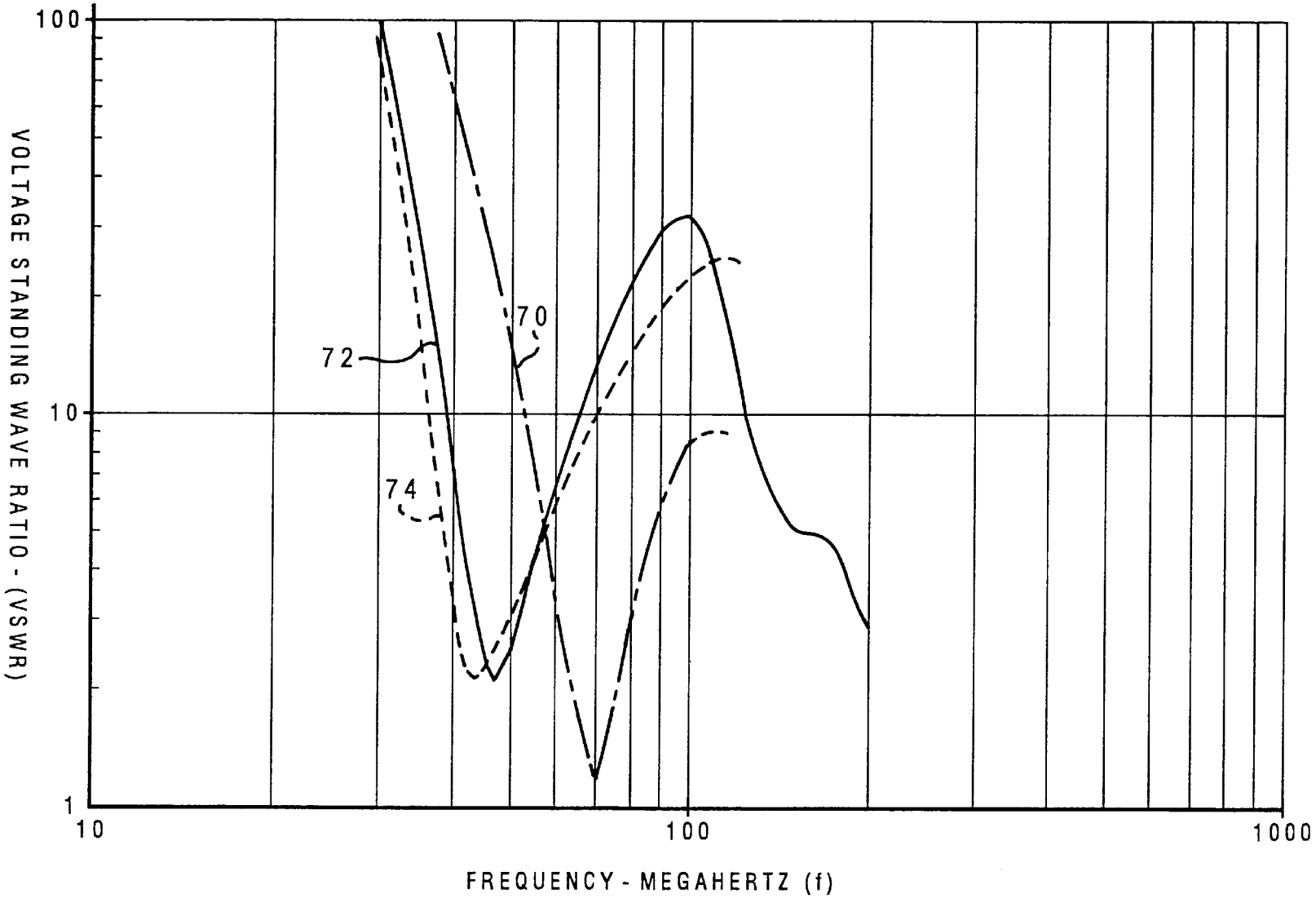
FIG. 2 is a diagram showing the improved low frequency performance characteristics of the antenna shown in FIG. 1 compared to a conventional triangular shaped element dipole antenna.

Referring now to FIG. 2, there is illustrated a diagram of voltage standing wave ratio (VSWR) versus frequency in megahertz, showing indicated performance characteristics of the antenna 10 as compared with a conventional opposed triangular element or "bowtie" dipole antenna. The performance curve indicated by the long-short dash line and numeral 70 shows the VSWR versus frequency characteristic of a conventional single plane opposed triangular element "bowtie" antenna having approximately the same dimensions as the antenna 10. The diagram indicates that the optimum VSWR for the above-mentioned single bowtie antenna occurs at about seventy megahertz whereas curve 72 (solid line) represents the performance characteristics of the antenna 10. Although antenna 10 has a slightly higher minimum VSWR this occurs at a frequency of about forty-seven megahertz. In many applications, a VSWR of 10.0 or more is acceptable and thus the folded triangular element antenna 10 has a significantly lower frequency operating range than a single plane bowtie antenna. Performance curve 74 indicates the influence of the spacing, b, see FIG. 1, of the folded triangular element antenna 10. By doubling the spacing b, for example, the performance characteristic of the antenna 10 will shift by the amount indicated by curve 74. Still further, it is indicated that by modifying the spacing, a, of the apexes 16, 36 and 18, 38, FIG. 1, further performance variations may be obtained. For example, an antenna 10 having an overall length, 1, between base members 26 of respective elements 12 and 14 or 32 and 34, of about 1.9 meters, an included angle between elements 22 and 24 of 60° at the apexes, a displacement, a, between triangular elements at the apexes of about 4.0 centimeters and displacements, b, of between 8.0 centimeters and 20.0 centimeters indicates that increasing the displacement, b, while maintaining the displacement, a, constant will lower the VSWR for a given operating frequency, as previously discussed and indicated in FIG. 2 by comparing curves 72 and 74. The diameters of the struts 22, 24, 26, 28 and 30 may be about 12.7 millimeters for the antenna having the other physical dimensions discussed hereinabove.

Figure 3A:
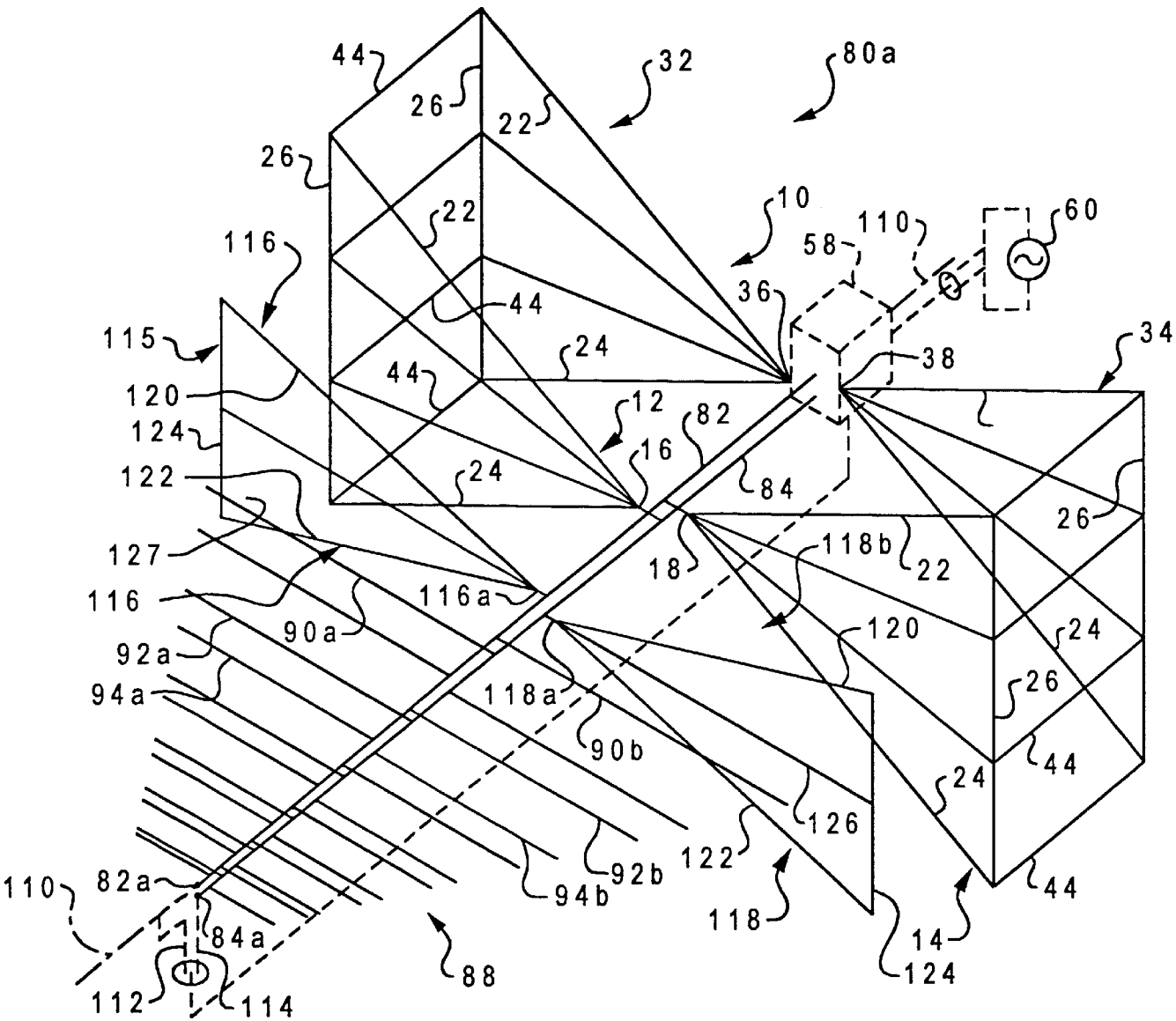
FIG. 3A is a perspective view, in somewhat schematic form, of an antenna array, particularly adapted for electromagnetic compatibility testing, and in accordance with the present invention.

Referring now to FIG. 3A, there is illustrated, in somewhat schematic form, an antenna or so-called antenna array, particularly adapted for electromagnetic radiation emissions and immunity testing and generally designated by the numeral 80. The antenna 80 includes the folded triangular element antenna 10 shown in FIG. 1 including the opposed triangular elements 12 and 14 connected to the second set of opposed triangular elements 32 and 34. In the antenna 80 the apexes 16 and 18 are mechanically and electrically connected to spaced apart elongated booms 82 and 84 formed of suitable conductive metal tubing, for example. The apexes 36 and 38 are shown connected to enclosure 58 which includes the aforementioned balun transformer 56, not shown in FIG. 3A. The enclosure 58 may be constructed of a suitable nonconductive material and the apexes 36 and 38 merely mechanically supported on the enclosure for structural stability purposes.

The elongated booms 82 and 84 also support a log periodic antenna array, generally indicated by numeral 88, and characterized by plural, opposed, wire or metal tube dipole antenna elements of respective lengths required for transmitting and receiving radiation of selected frequencies, in a known manner. Representative ones of the opposed wire dipole elements are shown and indicated by numerals 90*a*, 90*b*, 92*a*, 92*b*, 94*a* and 94*b*, as shown in FIG. 3A. A total of twenty-three wire dipole antennae may be mounted on booms 82 and 84, by way of example. Alternate antenna elements on the opposite side of centerline 110 of antenna 80 are connected to the respective booms 82 and 84 to provide the desired phase relationship for the signal received or emitted by the antenna 80. Signal reception or transmission from source 60 is communicated to the distal ends 82*a* and 84*a* of the booms 82 and 84 by suitable conductors 112 and 114 which are electrically connected to source 60 through the aforementioned balun transformer 56.

Referring further to FIG. 3A the antenna 80 also includes a shaped element dipole antenna 115, characterized by opposed triangular outline elements 116 and 118 comprising a single plane triangular element antenna electrically and mechanically connected to the respective booms 82 and 84, as shown in FIG. 3A. Antenna element 116 has an apex 116*a* and diverging wire or tube strut members 120 and 122 which diverge from apex 116*a* to a base member 124. An intermediate wire or tube strut 126 also extends between apex 116*a* and base 124. Antenna element 118 is virtually identical in construction and is characterized by base member 124 and struts 120, 122 and 124 interconnected between apex 118*a* and base member 124.

Figure 4A:
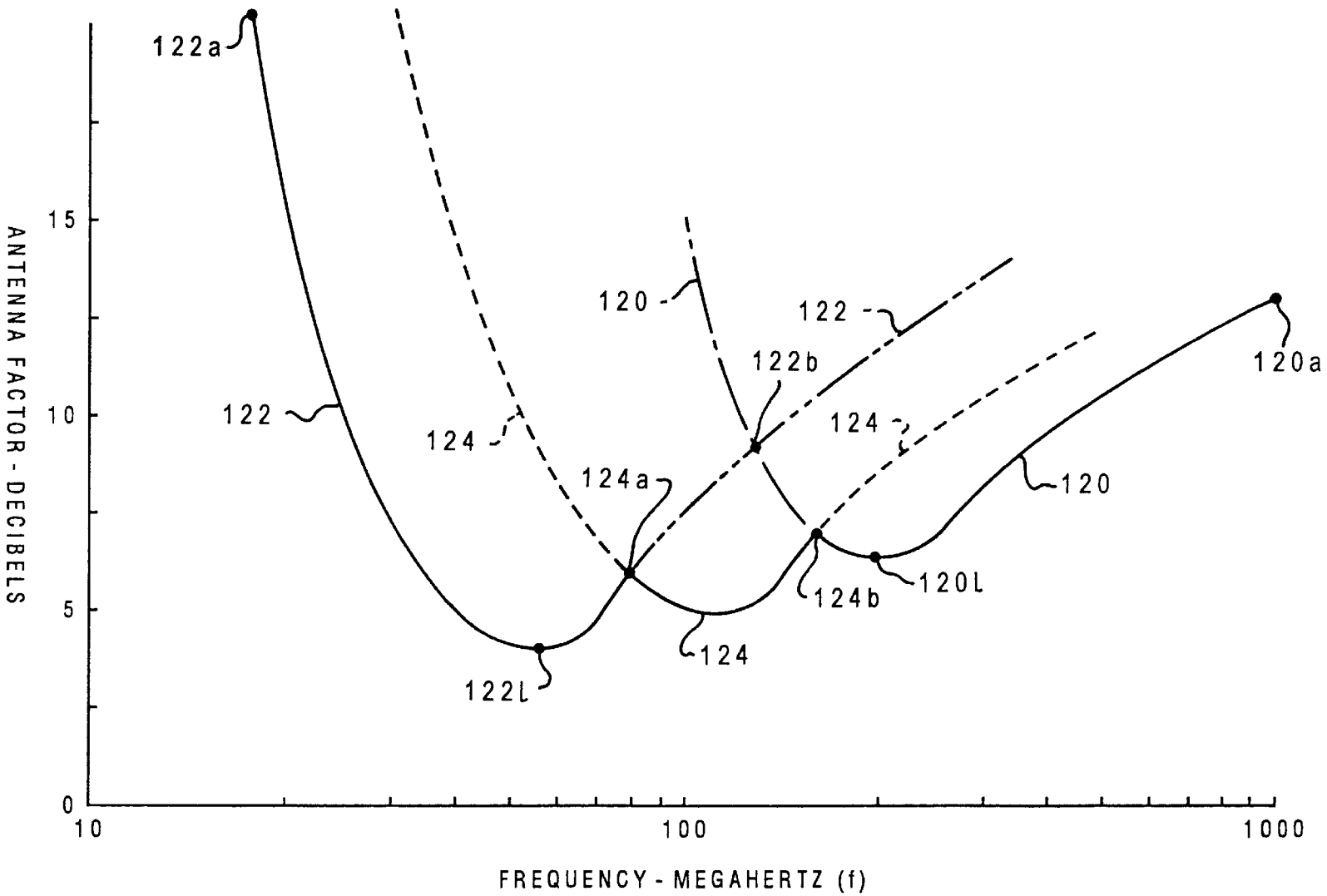
FIG. 4A is a diagram showing the antenna factor versus frequency for the antenna array of FIG. 3A.

Referring now to FIG. 4A, there is illustrated a semilogarithmic diagram of antenna factor in decibels versus frequency in megahertz for the antenna 80 and for its components operating alone. For example, the curve 120 including, the long-short dash portion, indicates typical performance characteristics of the log periodic antenna array 88 alone indicating that its operating range is generally greater than 100 to 200 megahertz. Antenna 10 has an indicated performance characteristic defined by curve 122, including the long-short-short dash portion. Accordingly, the combined performance of an antenna array characterized by an antenna 10 and an antenna array 88 would follow curves 122 and 120 between points 122*a,* 122*b* and 120*a* and would be superior to either antenna operating alone, especially for broad band applications. The combination of antennae 10 and 80 would have a slight deficiency in a signal frequency range of, for example, between the lowest values 1201 and 1221 of antenna factor for the respective curves 120 and 122. The overall antenna performance in a desired range of frequencies may be further improved by adding the shaped element dipole antenna 115 to the array 80 whose performance is indicated by dashed line curve 124. Accordingly, the antenna factor for the antenna 80 follows the solid line curve between points 122*a,* 124*a,* 124*b* and 120*a* and is minimal over a broader range of frequencies than any one of the antennas 10, 80 and 115 operating alone. The overall combination provided by the antenna 80 is thus a significant improvement, particularly for emissions and immunity or so-called electromagnetic compatibility testing applications.

Figure 4B:
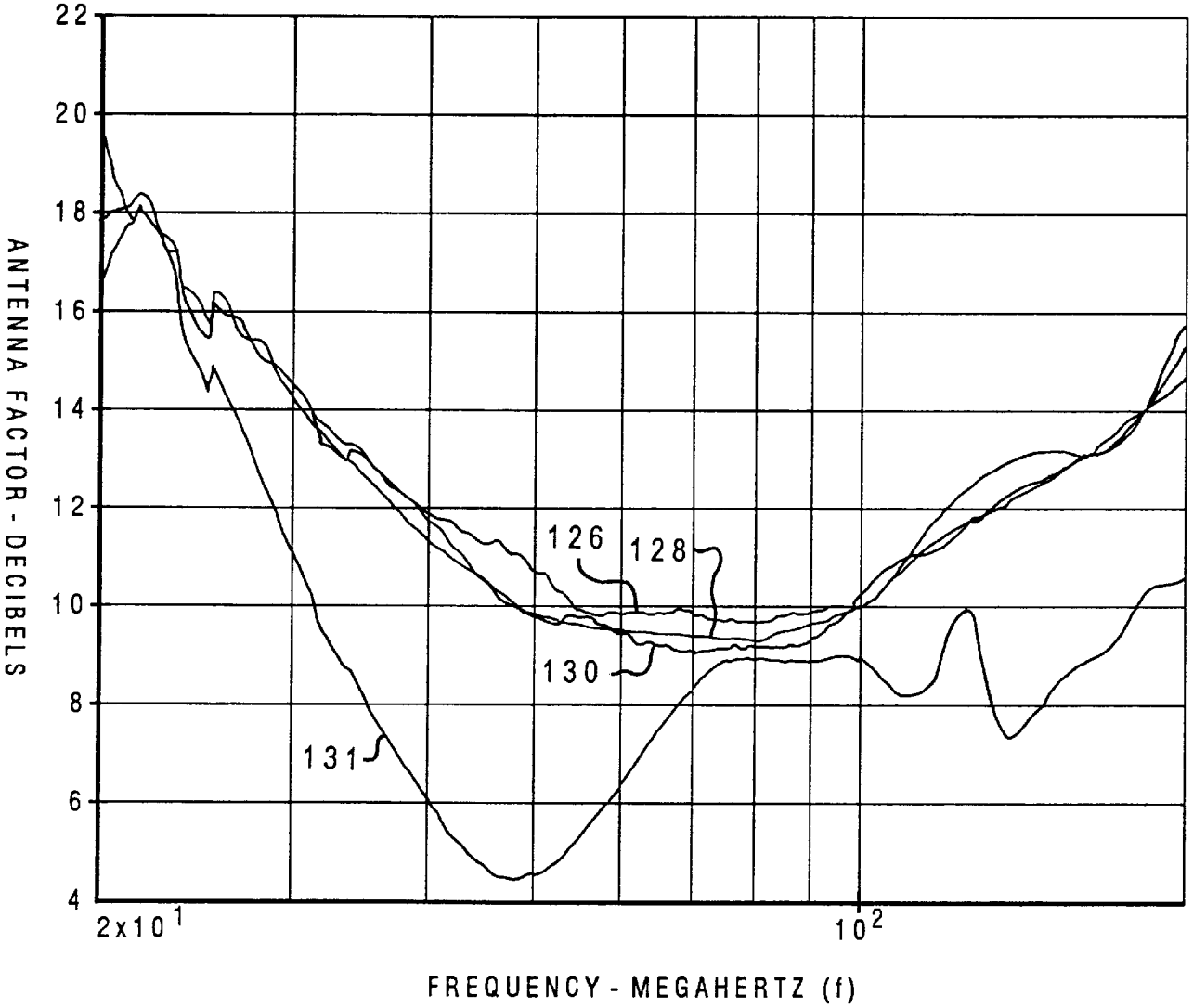
FIG. 4B is a diagram showing the antenna factor for prior art antennas compared with the antenna shown in FIG. 3A.

FIG. 4B also indicates the improvement in the antenna loss factor in decibels for the antenna 80 as compared with so-called biconical antennas of types currently commercially available and such as manufactured by the assignee of the present invention. For example, the clustered curves 126, 128 and 130 are indicative of the antenna factor versus frequency performance for opposed shaped element, so-called biconical antennas. Antenna 80, particularly in the range of twenty megahertz to four hundred megahertz, exhibits a significantly lower antenna factor as indicated by curve 131.

Figure 3B:
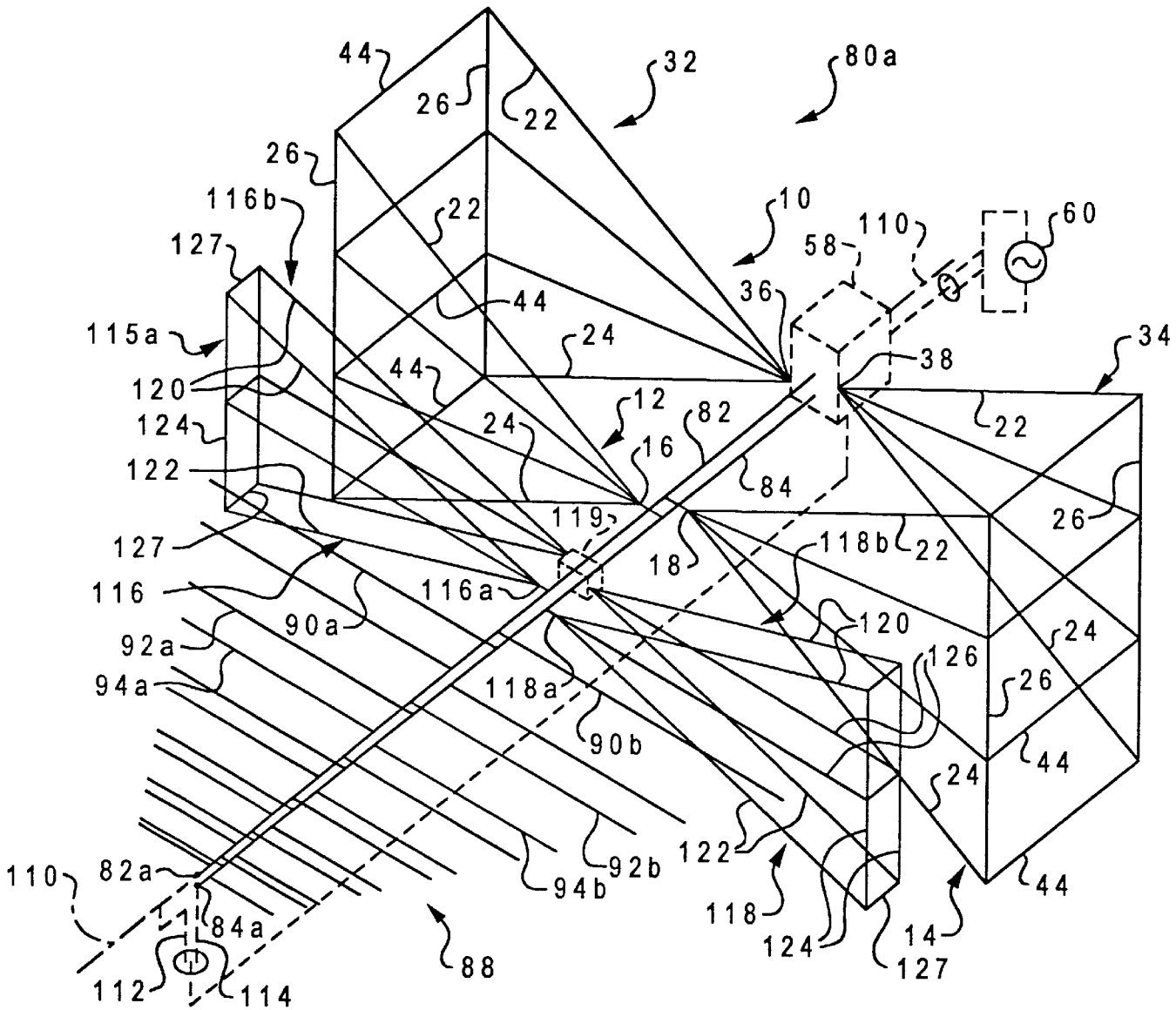
FIG. 3B is a perspective view of an alternate embodiment of the antenna shown in FIG. 3A.

Referring now to FIG. 3B, another embodiment of an antenna in accordance with the invention is illustrated and generally designated by the numeral 80*a*. The antenna 80*a* is similar in many respects to the antenna 80 with the exception that the single plane opposed triangular element antenna 115 is replaced by a folded opposed triangular element or "bowtie" dipole antenna 115*a*. The antenna 115*a* includes opposed wire triangular outline elements 116 and 118 and a second set of wire triangular outline antenna elements 116*b* and 118*b* which are interconnected to the triangular elements 116 and 118 at respective base members 124 by transverse struts 127, respectively. Accordingly, the antenna 80*a* includes two folded triangular outline shaped element dipole antennae 10 and 115*a* supported on the booms 82 and 84. The apexes of the triangular elements 116*b* and 118*b* are suitably structurally supported by a support member 119 mounted on the booms 82 and 84. Moreover, the apexes of the elements 116*b* and 118*b* may be either electrically isolated from each other or electrically connected by suitable conductive elements such as indicated for the antenna 10 as shown in FIG. 1. Of course, suitable lumped impedances may be disposed on the members of the elements 116 and 116*b* as well as the elements 118 and 118*b*.

Figure 5:
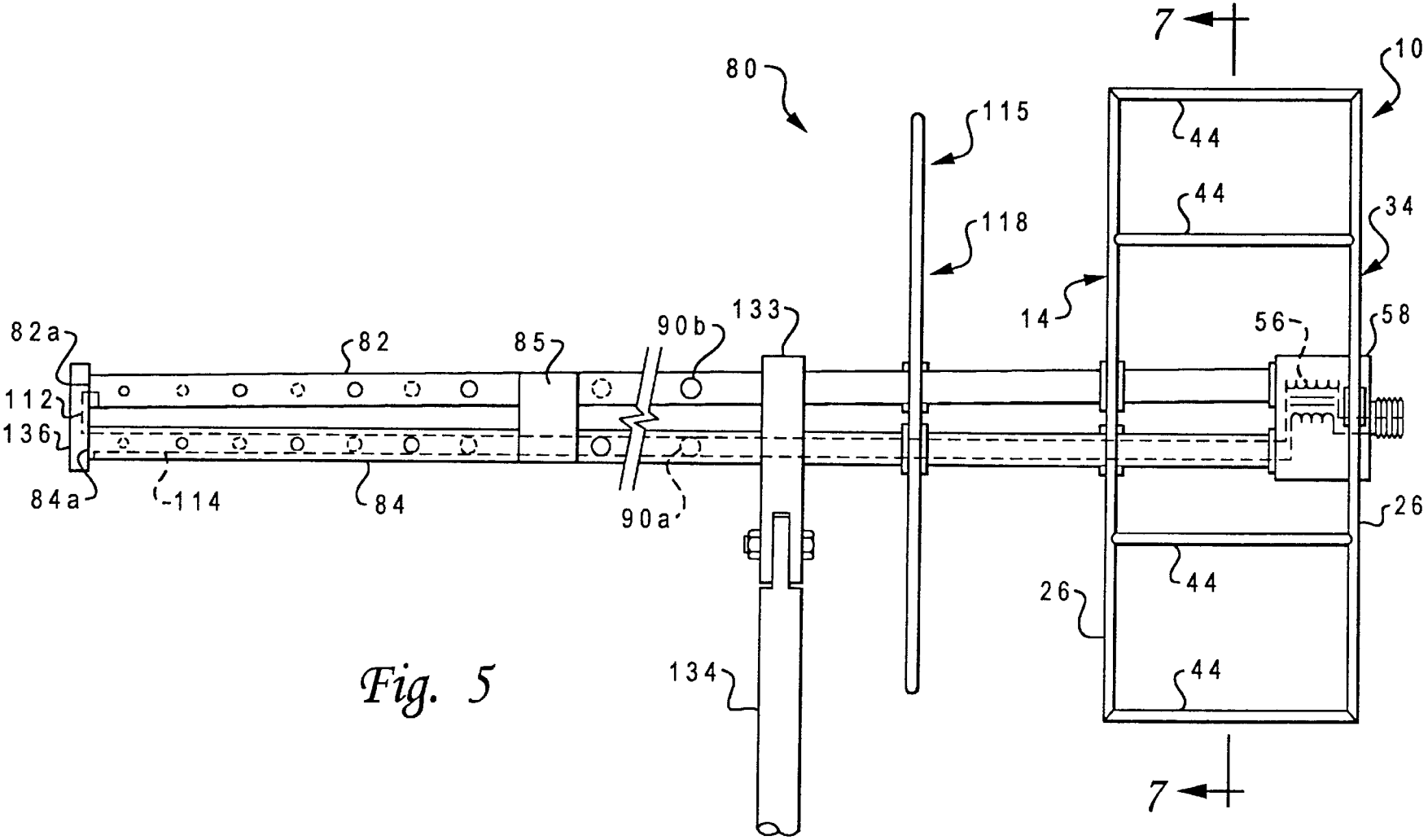
FIG. 5 is a side elevation of an antenna in accordance with the invention adapted for electromagnetic compatibility testing.
Figure 6:
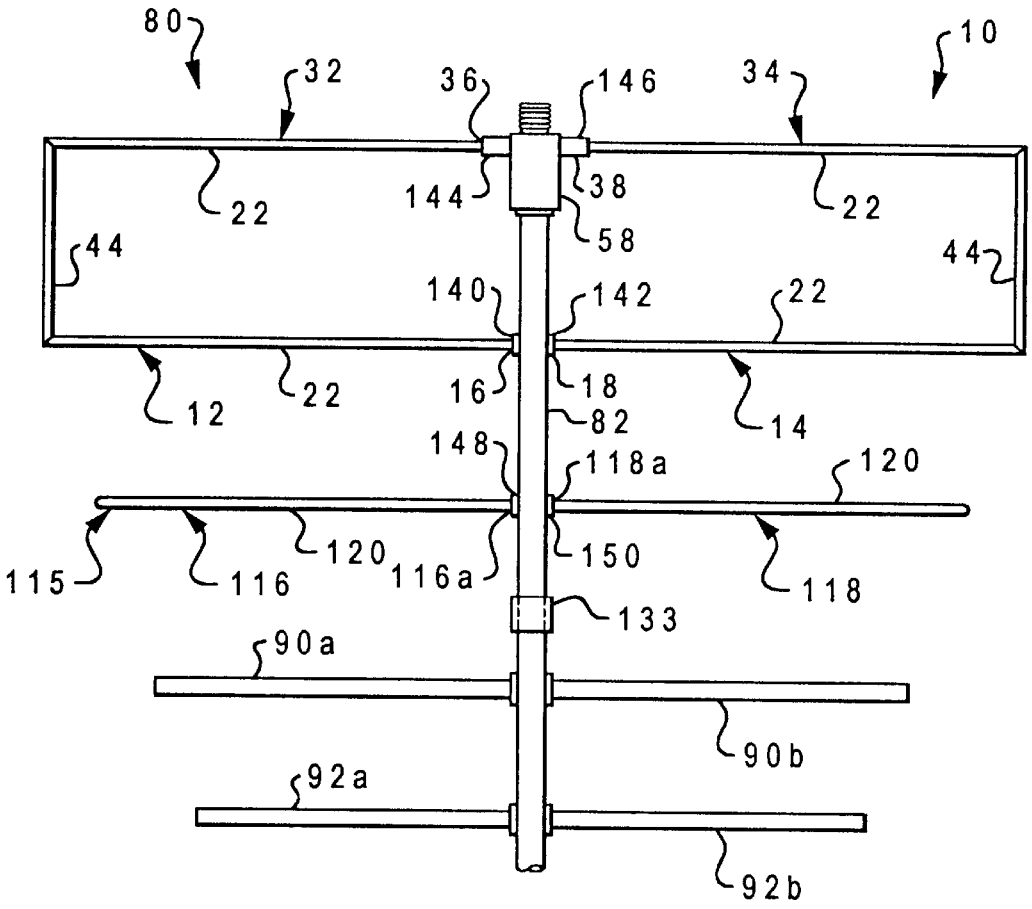
FIG. 6 is a partial plan view of the antenna shown in FIG. 5.
Figure 7:
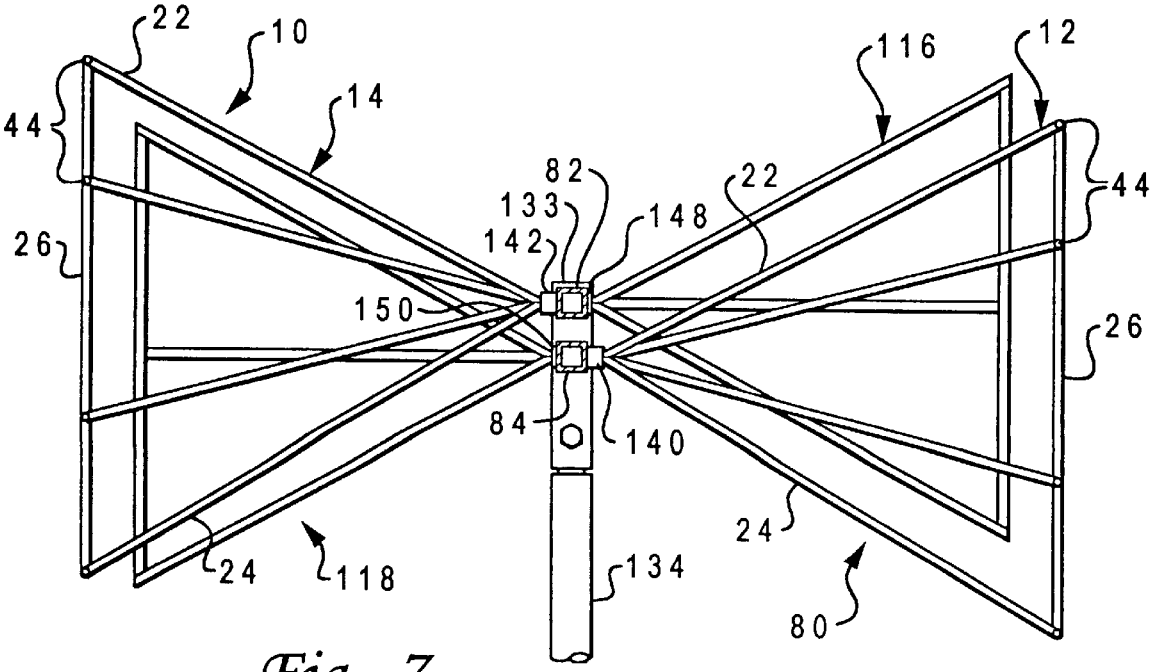
FIG. 7 is an end elevation of the antenna shown in FIG. 5.

FIGS. 5, 6 and 7 illustrate an exemplary embodiment of the antenna 80, particularly adapted for electromagnetic compatibility testing. The antenna 80 includes a mounting or support bracket 133 for mounting the antenna at its center of gravity on an upstanding mast 134. The booms 82 and 84 are preferably characterized as elongated rectangular cross section metal tubes of about 1.0 inch by 0.5 inch and the boom 84 is adapted to house the conductors 112 and 114 which are contained in a suitable insulating sheath leading from the box or enclosure 58 through the boom 84 to an end fitting 136 which supports the booms 82 and 84 at their distal ends opposite the enclosure 58. Booms 82 and 84 may be interconnected at one or more points intermediate their ends by suitable nonconductive brackets 85, one shown in FIG. 5. Each of the shaped elements 12, 14, 32, 34, 116 and 118 have suitable bracket members 140, 142, 144, 146, 148 and 150 supporting the respective apexes of these elements and adapted to be connected to the booms 82 and 84 or to the enclosure 58 with conventional mechanical fasteners, not shown. Each of the dipole elements 90*a,* 90*b* and so on are also suitably connected to the booms 82 and 84 by conventional mechanical fastening or by welding, if desired. The overall length of the antenna 80 along centerline 110 may be about 5.0 feet, the length of the base members 26 may be approximately 29.0 inches and the length of the elements 12, 14, 32 and 34 may be in the range of about 25.0 inches providing an overall length, 1, of about 50.5 inches. The included angle between the diverging elements 22 and 24 may be 60°, as indicated previously. However, the included angle between the outer diverging struts of the respective antennas 10, 115 and 115*a* may be modified in accordance with the desired range of signal frequencies for which optional antenna performance is desired. The length of the transverse elements 44 may be approximately 0.5 to 1.0 feet for an antenna having the performance indicated in FIG. 4B.

The construction and operation of the antennas 10, 80 and 80*a* and the components included therein are believed to be within the purview of one of ordinary skill in the art of broad band antennas based on the foregoing description. Those elements not described in detail may be constructed using conventional materials for antennas for receiving and transmitting electromagnetic radiation in the frequency ranges indicated herein.

Although preferred embodiments of the invention have been described in detail, those skilled in the art will recognize that various substitutions and modifications may be made to the invention without departing from the scope and spirit thereof as set forth in the appended claims.

What is claimed is:

1. A broad band antenna comprising a first set of opposed, substantially planar, triangular shaped antenna elements projecting in substantially opposite directions and having respective apexes connected to conductor means for transmitting signals to or from said antenna and a second set of opposed, substantially planar, triangular shaped antenna elements disposed adjacent said elements of said first set and projecting in opposite directions and having respective apexes disposed adjacent each other but not electrically connected to each other or to the apexes of the elements of said first set, the elements of said first set having base members, respectively, and the elements of said second set having base members, respectively, adjacent elements of said first and second sets being spaced from and substantially parallel to each other, respectively, and said elements of said first set and said second set being interconnected only at their respective base members so as to form a folded shaped element dipole antenna.

2. The antenna set forth in claim 1 wherein:

said triangular shaped elements are each characterized by opposed diverging wire or tube struts extending from said apex to said base member.

3. The antenna set forth in claim 2 wherein:

said triangular shaped elements include at least one intermediate strut extending between said apex and said base member.

4. The antenna set forth in claim 1 wherein:

said antenna has a length for its first resonance frequency which is less than 0.32 times the wave length of an electromagnetic radiation signal at said resonance frequency.

5. The antenna set forth in claim 4 wherein:

said antenna has a first resonance frequency wherein its length is about equal to 0.21 times the wave length of said signal at said resonance frequency.

6. The antenna set forth in claim 1 including:

a balun transformer connected to said antenna and to a source or receiver of a signal transmitted to or from said antenna and between said antenna and said source or receiver.

7. The antenna set forth in claim 1 in combination with:

a log periodic antenna array comprising a plurality of opposed wire dipole antennas electrically connected to said folded shaped element antenna.

8. The antenna set forth in claim 7 including:

another opposed shaped element antenna electrically connected to said folded shaped element antenna and said log periodic antenna array.

9. The antenna set forth in claim 8 wherein:

said another antenna comprises a single opposed triangular shaped element dipole antenna having opposed triangular outline elements with respective apexes electrically connected to said folded shaped element antenna and said log periodic antenna array.

10. The antenna set forth in claim 8 wherein:

said another antenna comprises a second folded shaped element antenna having a first set of opposed triangular shaped elements and a second set of opposed triangular shaped elements spaced from respective ones of said triangular shaped elements of said first set and electrically and mechanically connected to said triangular shaped elements of said first set, respectively.

11. The antenna set forth in claim 1 wherein:

said triangular shaped elements comprise elongated wire or tube struts and at least selected ones of said struts include lumped impedances interposed therein.

12. An antenna array comprising:

a folded shaped element antenna including a first set of opposed, generally planar, triangular shaped antenna elements projecting in opposite directions and having respective apexes connected to respective conductor means and a second set of opposed, generally planar, triangular shaped antenna elements having respective apexes disposed adjacent each other but not electrically connected to each other or to the apexes of the elements of said first set, said elements of said second set disposed adjacent to said elements of said first set and spaced from and substantially parallel to said first set of antenna elements, said antenna elements each having respective base portions opposite their apexes, respectively, and said adjacent elements of said first and second sets are interconnected only at their respective base portions by transverse members, respectively; and a log periodic dipole antenna connected to said first set of triangular shaped antenna elements, respectively, via respective conductor means.

13. The antenna array set forth in claim 12 wherein:

said antenna includes a second shaped element dipole antenna electrically connected to said folded shaped element antenna and said log periodic antenna to minimize the antenna factor in a predetermined frequency range of signals emitted or received by said antenna array.

14. The antenna array set forth in claim 13 wherein:

said second shaped element dipole antenna comprises at least one of a single opposed triangular element dipole antenna and a folded triangular element dipole antenna.

15. An electromagnetic compatibility test antenna characterized by:

spaced apart elongated electrically conductive boom members;

a first shaped element antenna connected to said boom members comprising a first set of opposed, triangular shaped, antenna elements having respective apexes connected to respective ones of said boom members and having respective base members disposed spaced from said boom members, and a second set of opposed, triangular shaped, antenna elements having respective apexes disposed adjacent but not electrically connected to one another or to the apexes of the elements of said first set, said second set of antenna elements being spaced from and substantially parallel to respective ones of said antenna elements of said first set and having base members disposed adjacent to and spaced from the base members of said antenna elements of said first set and connected thereto, respectively, said elements of said first set and said elements of said second set being connected to each other, respectively, at their respective base portions;

a second shaped element dipole antenna comprising opposed, triangular shaped, antenna elements connected to respective ones of said boom members at respective apexes of said triangular shaped elements of said second shaped element antenna; and a log periodic antenna array comprising plural opposed wire dipole antenna members connected to said boom members, respectively, at points spaced from said first and second shaped element antennas.

* * * * *